US010691152B2

(12) United States Patent
Fiocchi et al.

(10) Patent No.: US 10,691,152 B2
(45) Date of Patent: Jun. 23, 2020

(54) LOW-DROPOUT REGULATOR HAVING SOURCING AND SINKING CAPABILITIES

(71) Applicant: ams International AG, Rapperswil (CH)

(72) Inventors: Carlo Fiocchi, Belgioioso (IT); Marco Cerchi, Cornale Bastida (IT)

(73) Assignee: ams International AG, Rapperswil (CH)

( * ) Notice: Subject to any disclaimer, the term of this patent is extended or adjusted under 35 U.S.C. 154(b) by 0 days.

(21) Appl. No.: 16/485,831

(22) PCT Filed: Jan. 12, 2018

(86) PCT No.: PCT/EP2018/050732
§ 371 (c)(1),
(2) Date: Aug. 14, 2019

(87) PCT Pub. No.: WO2018/153565
PCT Pub. Date: Aug. 30, 2018

(65) Prior Publication Data

US 2020/0050225 A1 Feb. 13, 2020

(30) Foreign Application Priority Data

Feb. 27, 2017 (EP) ..... 17158151

(51) Int. Cl.
*G05F 1/575* (2006.01)

(52) U.S. Cl.
CPC ..... *G05F 1/575* (2013.01)

(58) Field of Classification Search
CPC ..... G05F 1/575
See application file for complete search history.

(56) References Cited

U.S. PATENT DOCUMENTS 5,446,412 A * 8/1995 Kimyacioglu ..... H03F 3/3001 330/253
8,222,877 B2 7/2012 Cerchi et al.
(Continued)

FOREIGN PATENT DOCUMENTS

CN 101893908 A 11/2010
CN 102411394 4/2012
(Continued)

OTHER PUBLICATIONS

Brehmer,K. et al: "Large Swing CMOS Power Amplifier", IEEE Journal of Solid-State Circuits, vol. 18, No. 6, pp. 624-629 (Dec. 1983).

(Continued)

*Primary Examiner* — Kyle J Moody
(74) *Attorney, Agent, or Firm* — Fish & Richardson P.C.

(57) ABSTRACT

A low-dropout regulator comprises an output current branch (100) in which a first output driver (110) and a second output driver (120) is arranged. An input amplifier stage (200) provides a first control current (I1) to control the operating state of the first and the second output driver (110, 120). A current generator unit (300) provides a second control current (12) to operate the first output driver (110) in the second operating state and provides a third control current (13) to operate the second output driver (120) in the second operating state, when the first control current (I1) of the input amplifier stage (200) is below a threshold level.

15 Claims, 4 Drawing Sheets

(56) References Cited

U.S. PATENT DOCUMENTS

| | | | | |
|---|---|---|---|---|
| 8,513,929 | B2 * | 8/2013 | Drebinger | G05F 1/575 323/273 |
| 9,541,933 | B2 * | 1/2017 | Knoedgen | G05F 1/575 |
| 9,575,500 | B2 | 2/2017 | Kronmueller et al. | |
| 9,778,667 | B2 * | 10/2017 | Peluso | G05F 1/575 |
| 10,324,481 | B2 * | 6/2019 | Dahl | G05F 1/575 |
| 10,429,878 | B2 * | 10/2019 | Wu | G01R 31/2855 |
| 2009/0128104 | A1 * | 5/2009 | Mandal | G05F 1/565 323/273 |
| 2009/0302683 | A1 | 12/2009 | Wu et al. | |
| 2011/0121800 | A1 | 5/2011 | Drebinger | |
| 2014/0062594 | A1 * | 3/2014 | Sbuell | H03F 3/3044 330/253 |
| 2015/0311783 | A1 | 10/2015 | Saadat et al. | |
| 2015/0340995 | A1 | 11/2015 | Story et al. | |
| 2015/0378377 | A1 | 12/2015 | Kronmueller et al. | |
| 2016/0187902 | A1 | 6/2016 | Zeng | |
| 2017/0038783 | A1 | 2/2017 | Chen et al. | |

FOREIGN PATENT DOCUMENTS

| | | | |
|---|---|---|---|
| CN | 105811905 | A | 7/2016 |
| CN | 106233600 | A | 12/2016 |
| CN | 106292815 | A | 1/2017 |
| CN | 106451386 | A | 2/2017 |
| EP | 2 328 056 | | 6/2011 |

OTHER PUBLICATIONS

Castello, R. et al: "A high-performance micropower switched-capacitor filter", IEEE Journal of Solid-State Circuits,vol. sc-20, No. 6, pp. 1122-1132 (Dec. 1985).

European Patent Office, International Search Report for PCT/EP2018/050732 (dated Mar. 20, 2018).

Fisher, J. "A High-Performance CMOS Power Amplifier", IEEE Journal of Solid-State Circuits, vol. sc-20, No. 6, pp. 1200-1205 (Dec. 1985).

Huijsing, J.H. "Operational Amplifiers Theory and Design", Kluwer Academic Publishers, pp. 315-322 (2001).

Cui Chuan-rong et al.: "Low dropout regulator with no off-chip capacitor and low power consumption", Journal of Zhejiang University, vol. 43, No. 11, Nov. 2009, pp. 2006-2011.

Yang, Y. et al., "A Novel Adaptive CMOS Low-Dropout Regulator with 3A Sink/Source Capability", IEEE, International Conference on ASIC(ASICON), 2015, $11^{th}$, 4 pages.

Office Action issued in Chinese Application No. 201880013658.2, dated Apr. 2, 2020, 7 pages.

* cited by examiner

LOW-DROPOUT REGULATOR HAVING SOURCING AND SINKING CAPABILITIES

TECHNICAL FIELD

The disclosure relates to a low-dropout regulator having sourcing and sinking capabilities.

BACKGROUND

A low-dropout regulator (LDO) is a DC linear voltage regulator that can regulate the output voltage even when the supply voltage is very close to the output voltage. The LDO provides a regulated output voltage at an output node that may be used to supply a load. LDOs are traditionally unidirectional power supplies, i.e. they usually source a current, if the LDO for example replaces a battery.

The design of LDOs is a challenging task in most cases because of stability concerns. They are intrinsically associated with a device that must source a large current into a big load capacitor. To ensure the required drive capability for an output driver/transistor of the LDO, a large swing is needed at its gate. This automatically implies the presence of a (at least moderately) large impedance node. In addition, the parasitic at the gate of the output transistor is large. Thus, there are possibilities for a low frequency cut-off pole.

At the same time, the output node of an LDO, loaded by a capacitor which might be as large as possible to ensure a precise regulated voltage, fits well into the role of a dominating pole in the regulation loop. This means that the total phase margin of the circuit structure is expected to be quite poor.

It is evident that it could be quite complicated to ensure that the LDO is endowed with a bidirectional current capability, i.e. not only the usual sourcing one but also a sinking capability. In fact, the circuitry to correlate the drive at a pull-up device of the LDO to a pull-down device of the LDO would unavoidably introduce other poles and other large parasitics because of the large size of the sinking element.

It is obvious that as soon as the output branch of an LDO is made by a series connection of two large devices, the need to keep their bias current under control is absolutely mandatory. Any offset or mismatching, even in a properly designed architecture, would make this value unacceptably high because a key feature of an LDO is to dissipate as little power as possible if unloaded.

It is desired to provide a low-dropout regulator having sourcing and sinking capabilities, wherein the LDO has low power consumption in the sourcing and sinking operation mode as well as in the unloaded state.

SUMMARY

A low-dropout regulator having sourcing and sinking capabilities, wherein the regulator dissipates as little power as possible is specified in claim 1.

The low-dropout regulator comprises an output node to provide a regulated output voltage. The LDO further comprises an output current branch coupled to the output node, the output current branch comprising a first output driver and a second output driver. The first and the second output drivers are configured to be operated in a first and a second operating state. The respective conductivity of the first and the second output drivers is higher in the first operating state than in the second operating state.

The LDO further comprises an input amplifier stage having an input side to apply an input signal and an output side to provide a first control current to control the operating state of the first and the second output drivers. The input amplifier stage generates the first control current in dependence on the input signal. The LDO comprises a current generator unit to provide a second control current to operate the first output driver in the second operating state and to provide a third control current to operate the second output driver in the second operating state, when the first control current at the output side of the input amplifier stage is below a threshold level.

The structure of a traditional LDO just having a sourcing capability is doubled so that the output branch of the LDO comprises a first and an additional second output driver. The LDO has sourcing and sinking capabilities by providing the first and a second output drivers in the output current branch. In dependence on operating the LDO in the sourcing or sinking operation mode, only one of the two output drivers is operated in a high conductive state, whereas the other one of the two output drivers is operated with lower conductivity or even with no conductivity. That means that the LDO is configured as a fully class AB approach unlike usual LDO solutions.

Furthermore, the current generator unit allows to operate both of the first and second output drivers in the output current branch with low or even no conductivity, when the input signal applied to the input amplifier stage and the first control current has a low level or the output node of the LDO is unloaded. Only under a large signal condition of the input signal at the input side of the input amplifier stage is one of the output drivers of the output current branch turned into the conductive state, while the other of the first and second output drivers is turned in the low-conductive or non-conductive state. Since in any case one or both of the output drivers are turned into the low-/non-conductive state, the LDO has a low power consumption. The quiescent current is made minimal even in the presence of large mismatching.

DETAILED DESCRIPTION

Figure 1:
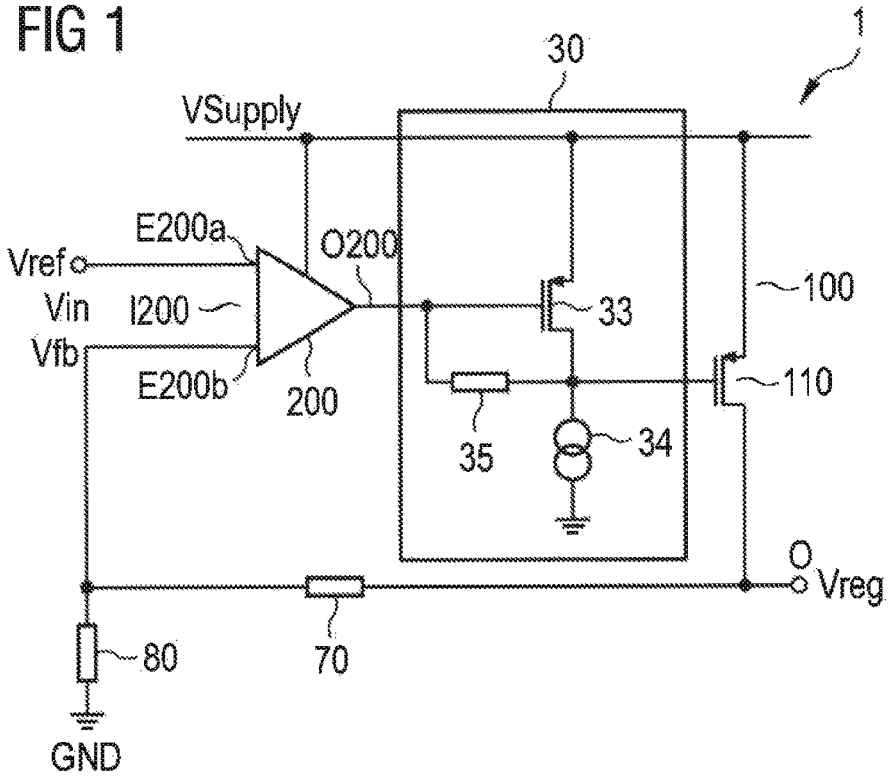
FIG. 1 shows an embodiment of a transimpedance-based regulator having sourcing capability.

FIG. 1 shows a transimpedance-based architecture 1 of an LDO comprising an output current branch 100 including an output driver 110 that is arranged between a supply line Vsupply and an output node O of the LDO to provide a regulated output voltage Vreg. The output driver 110 may be configured as an output transistor. The output node O is fed back by a feedback path comprising resistors 70 and 80 to an input side 1200 of an input amplifier stage 200. The input amplifier stage 200 has a first input node E200*a* to apply a reference signal Vref and a second input node E200*b* to apply the fed back signal Vfb derived from the regulated output voltage Vreg.

An output side O200 of the input amplifier stage 200 is coupled to a transimpedance amplifier stage 30 that is arranged between a control connection of the output driver 110 and the output side O200 of the input amplifier stage 200. The transimpedance amplifier 30 comprises a transistor 33, a current source 34 and a resistor 35. The transistor 33 and the current source 34 are coupled in series between the supply line Vsupply and a reference potential. The resistor 35 is arranged between the drain connection of the transistor 33 and the output side O200 of the input amplifier stage 200.

The output driver 110 may be configured as a power transistor that is driven with a low impedance given by the transconductance of the transistor 33 for a fast drive of its parasitic. The large resistor 35 allows sufficient gain without cutting the large capacitance at the output transistor gate. This arrangement allows the dominant pole at the output node with safe gain and phase margin values. Due to the large value for the transconductance of the transistor 33, the second loop pole can be shifted at a very high frequency and the dominant pole is at the output node. Hence an output capacitor can be increased without limitation to make the regulated output voltage as precise as possible against load current fast variations.

Virtual ground of the transimpedance stage 30 is set to the gate-source voltage of the output transistor 110 for a given current. This determines the load current value that gives the zero offset condition at the LDO input and sets the proper control in the output stage current.

In the implementation of the LDO shown in FIG. 1, the output transistor 110 and the transistor 33 of the transimpedance amplifier stage 30 are matched devices so that the output driver 110 will tend to drive n-times the current across the resistor 35 as soon as the drop across the resistor 35 is zero. As the output voltage Vreg is pulled down by the load only, the current across the output driver 110 remains equal to a load current regardless of any offset between the output transistor 110 and the transistor 33 of the transimpedance amplifier stage 30 and any offset current from the input amplifier stage 200 to the resistor 35.

Figure 2:
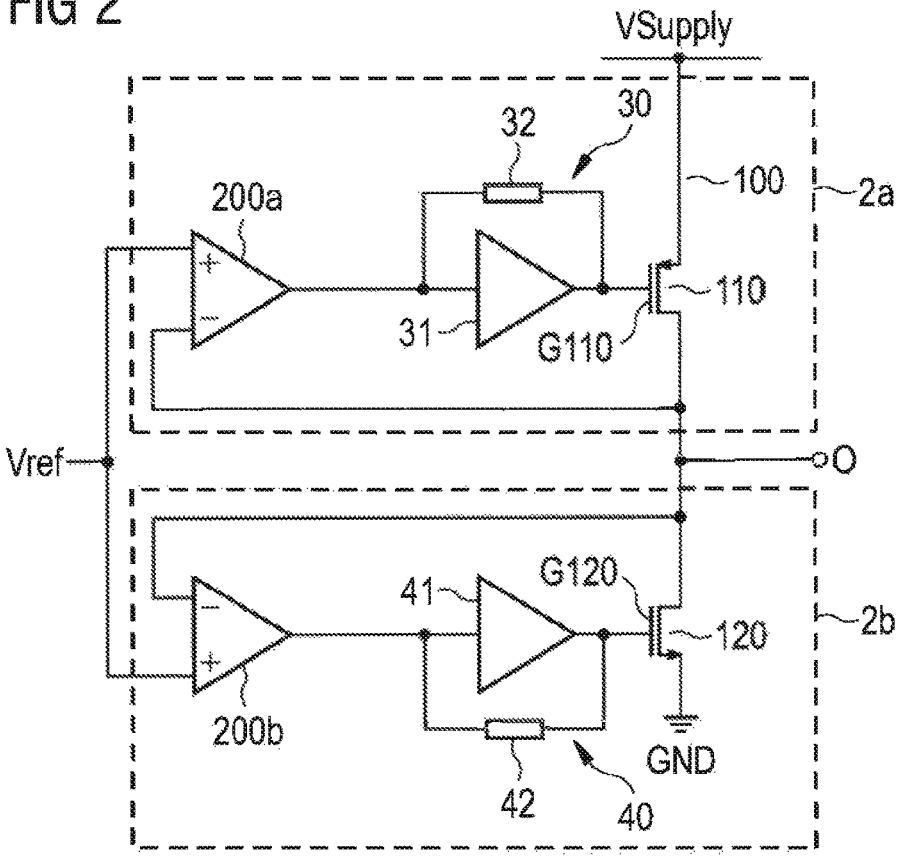
FIG. 2 illustrates a conceptual implementation of an LDO having sourcing and sinking capabilities.

The advantages of the circuit structure shown in FIG. 1 can be exploited by implementing a complementary LDO having both sourcing and sinking capabilities, according to the implementation shown in FIG. 2.

FIG. 2 shows a conceptual implementation of an LDO. The circuit structure of the LDO illustrated in FIG. 1 is doubled so that the LDO in FIG. 2 comprises an LDO up-portion 2*a* and an LDO down-portion 2*b*. The LDO up-portion 2*a* comprises a first output driver 110 arranged between a supply line Vsupply and an output node O. The output driver 110 may be configured as an output transistor. The LDO up-portion further comprises an input amplifier stage 200*a*, and a transimpedance amplifier stage 30 comprising a transimpedance amplifier 31 and a resistor 32 that couples the output of the transimpedance amplifier 31 back to the input connection of the transimpedance amplifier 31. The transimpedance amplifier stage 30 is coupled between a control connection G110 of the output driver 110 and the output side of the input amplifier stage 200*a*. A reference signal Vref is applied at an input connection, for example a non-inverting input connection, of the input amplifier stage 200*a*. A second connection, for example an inverting connection, of the input amplifier stage 200*a* is connected to the output node O of the LDO amplifier.

The LDO down-portion 2*b* comprises an output driver 120 arranged between the output node O and the reference potential. The output driver 120 may be configured as an output transistor. The LDO down-portion 2*b* further comprises an input amplifier stage 200*b* and a transimpedance amplifier stage 40. The transimpedance amplifier stage 40 is arranged between a control connection G120 of the output driver 120 and an output side of the input amplifier stage 200*b*. The transimpedance stage 40 comprises a transimpedance amplifier 41 and a resistor 42 that couples the output of the transimpedance amplifier 41 back to the input connection of the transimpedance amplifier 41. The reference signal Vref is applied to a first input connection, for example a non-inverting input connection, of the input amplifier stage 200*b*. The output node O is connected to a second input connection, for example an inverting input connection, of the input amplifier stage 200*b*.

The output drivers 110 and 120 are connected in series in an output branch 100 of the LDO regulator between a supply line Vsupply and a reference potential. The output drivers are configured as transistors of a different type of conductivity. The output driver 110 may be configured, for example, as a PMOS transistor, and the output driver 120 may be configured, for example, as an NMOS transistor. The transimpedance 32, 42 can be set with different values, especially since the output driver 120, for example the NMOS transistor, asks for lower overdrive than the output driver 110, for example the PMOS counterpart.

FIG. 2 shows shows a unity gain for the LDO stage, as it is only conceptual. Of course a feedback net can be adopted to make the regulated output voltage Vreg higher than the value of the reference voltage Vref. In this case, one resistor goes from the output side O of the LDO to the negative inputs (the same node is shared by both) of the amplifiers 200*a* and 200*b* and a second resistor from the shared input to ground.

The implementation of the LDO amplifier shown in FIG. 2 has some significant drawbacks in practical use. The offset in one stage, for example the LDO up-portion 2*a* or the LDO down-portion 2*b*, may cause large conduction in the associated power transistor. Assuming that the offset of the LDO portions 2*a* and 2*b* is uncorrelated, the offset of the other branch might be capable of fully absorbing this current increase. In this way the current in the output current branch 100 is no longer fixed by the load one only and unacceptably large value of power consumption might come even for light load values.

Figure 3:
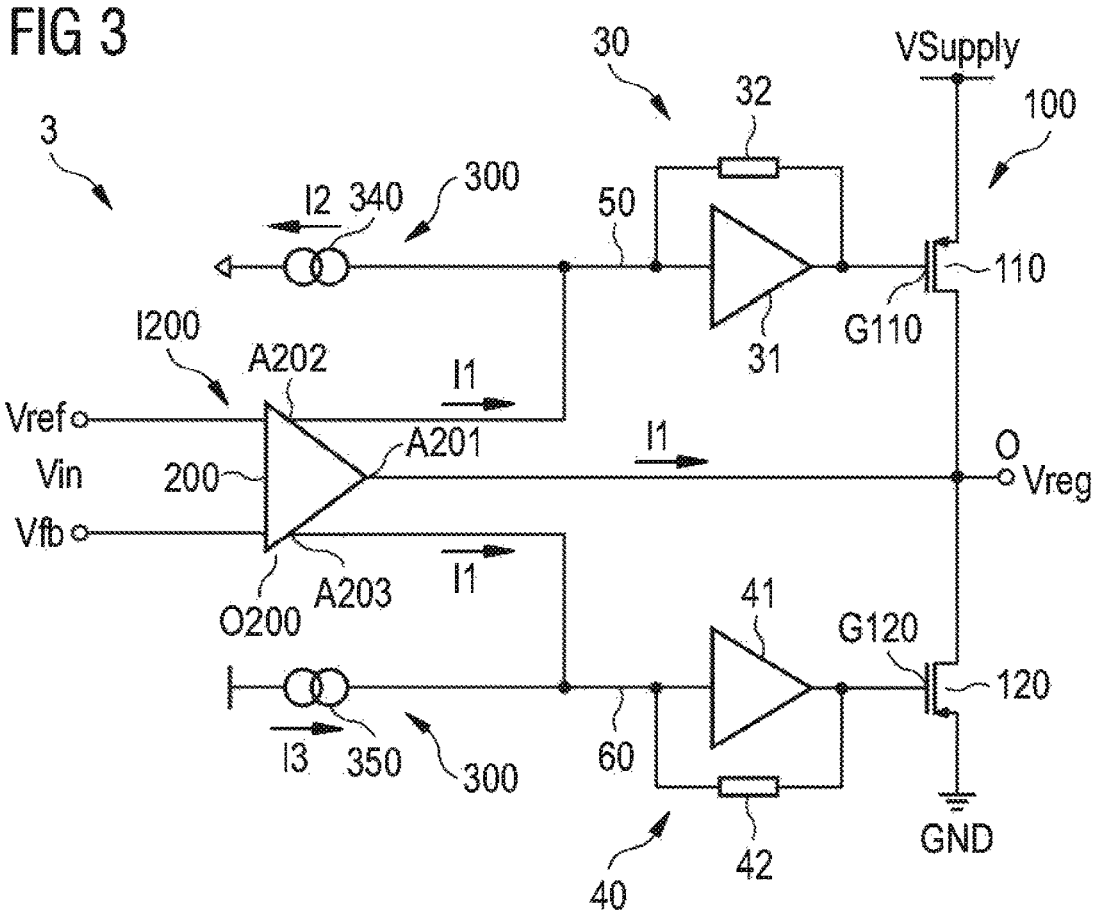
FIG. 3 shows an embodiment of an LDO having sourcing and sinking capabilities and a low power consumption by minimizing crowbar.

FIG. 3 shows an improved embodiment of an LDO 3 having sourcing and sinking capabilities, wherein the crowbar issue, i.e. the contemporary conduction of the two output drivers/transistors 110 and 120, is avoided by adding a systematic offset at the input of the two LDO branches 50 and 60.

According to the embodiment of the LDO 3 of FIG. 3, the LDO comprises an output node O to provide a regulated output voltage Vreg, wherein the output node O is arranged in an output current branch 100 of the LDO. The output current branch 100 comprises a first output driver 110 that may be configured as an output transistor and a second output driver 120 that may be configured as an output transistor. The output driver 110 and the output driver 120 are configured of a different type of conductivity. The output driver 110 may be configured as a PMOS transistor, and the output driver 120 may be configured as an NMOS transistor.

The first and the second output drivers 110, 120 are configured to be operated in a first and a second operating state. The respective conductivity of the output driver 110 and the output driver 120 is higher in the first operating state than in the second operating state of the transistors. The first operating state may be the conductive state of the output drivers and the second operating state may be the non-conductive state.

The LDO 3 comprises an input amplifier stage 200 having an input side 1200 to apply an input signal Vin and an output side O200 to provide a first control current I1 to control the operating state of the output drivers 110 and 120. The input amplifier stage 200 generates the first control current I1 in dependence on the input signal Vin being a differential signal derived from the reference signal Vref and the fed back signal Vfb.

The LDO 3 comprises a current generator unit 300 to provide a second control current I2 to operate the output driver 110 in the second operating state, for example the non-conductive operating state, and to provide a third control current I3 to operate the output driver 120 in the second operating state, for example the low-conductive/non-conductive operating state, when the first control current I1 at the output side O200 of the input amplifier stage 200 is below a threshold level, for example, is a zero signal.

The LDO 3 comprises a first transimpedance amplifier stage 30 being connected to a control connection G110 of the output driver 110. The LDO 3 further comprises a second transimpedance amplifier stage 40 being connected to a control connection G120 of the output driver 120. Each of the transimpedance amplifier stages 30 and 40 comprises a transimpedance amplifier 31, 41 and a resistor/transimpedance 32, 42 that is connected between the input and the output connection of the respective transimpedance amplifier 31, 41.

The input amplifier stage 200 has three output connections at its output side O200. The input amplifier stage 200 comprises a first output connection A201 to provide/receive the first control current I1. The first output connection A201 of the input amplifier 200 is connected to the output node O of the LDO 3. The input amplifier stage 200 comprises at the output side O200 a second output connection A202 and a third output connection A203 to provide/receive the first control current I1. The second output connection A202 of the input amplifier stage 200 is connected to the first transimpedance amplifier stage 30. The third output connection A203 of the input amplifier stage 200 is connected to the second transimpedance amplifier stage 40. The three current branches at the output side O200 must match precisely, but it is not necessary that they have the same nominal value. They can be different multiples from a unit value, this being especially true for the branch directly feeding the LDO output O.

The current generator unit 300 comprises a first current generator 340 and a second current generator 350. The first current generator 340 is connected to the first transimpedance amplifier stage 30 to provide the second control current I2 that causes to operate the output driver 110 in the second operating state, for example the non-conductive operating state. The second current generator 350 is connected to the second transimpedance amplifier stage 40 to provide the third control current I3 that causes to operate the output driver 120 in the second operating state, for example the non-conductive operating state.

The LDO 3 of FIG. 3 is configured as a class AB regulator. The class AB property is ensured by the control current I1 being injected into the two transimpedance stages 30 and 40, both on the pull-up side represented by the transimpedance stage 30 and the pull-down side represented by the transimpedance stage 40.

In the case of a positive value of the control current I1, i.e. if the LDO is operated in the sourcing operation mode and the control current I1 is injected by the input amplifier stage 200 in the transimpedance stages 30 and 40, the output driver 110 is turned on, i.e. switched in a state of high conductivity, so that the current flowing through the output driver 110 is increased. On the other hand, the control current I1 injected in the transimpedance stage 40 has the effect that the output driver 120 moves to an even deeper turn-off status, i.e. to a state of low conductivity or no conductivity.

For a negative value of the control current I1, i.e. if the LDO 3 is operated in the sinking operation mode and the control current I1 exits the current generator unit 300 and is injected in input amplifier stage 200, the output driver 110 is turned off or turned in a low-conductive state/non-conductive state, while the output driver 120 is turned on or turned in a high conductive state.

When the input voltage of the input amplifier stage 200 is very small, the control current I2 provided by the current generator 340 turns the output driver 110 off, i.e. in an operation state of low conductivity or the non-conductive operation state, and the control current I3 provided by the current generator 350 turns the output driver 120 off, i.e. in an operation state of low conductivity or the non-conductive operation state. That means that in the unloaded configuration both of the output drivers 110 and 120 are controlled by the control currents I2 and I3 so that both of the output drivers are operated in an operation state of low conductivity or in a non-conductive state.

As for both branches, i.e. the pull-up and pull-down branch, the original structure shown in FIG. 1 is preserved. The stability concerns are unaltered, and in particular, a Miller compensation is not required. The output node A201 directly drives the output node O and ensures the loop closure when the control current I1 is zero or very small (I1<I2 or I1<I3). The LDO may be embodied such that the control currents I2 and I3 are equal DC currents. Alternatively to the embodiment of the LDO shown in FIG. 3 in which the control current I2 and I3 turn off the output drivers 110 and 120, the virtual ground of the two transimpedance stages 30 and 40 can be set slightly different from the gate source voltage implemented in the embodiment shown in FIG. 1 to achieve the same result.

Figure 4:
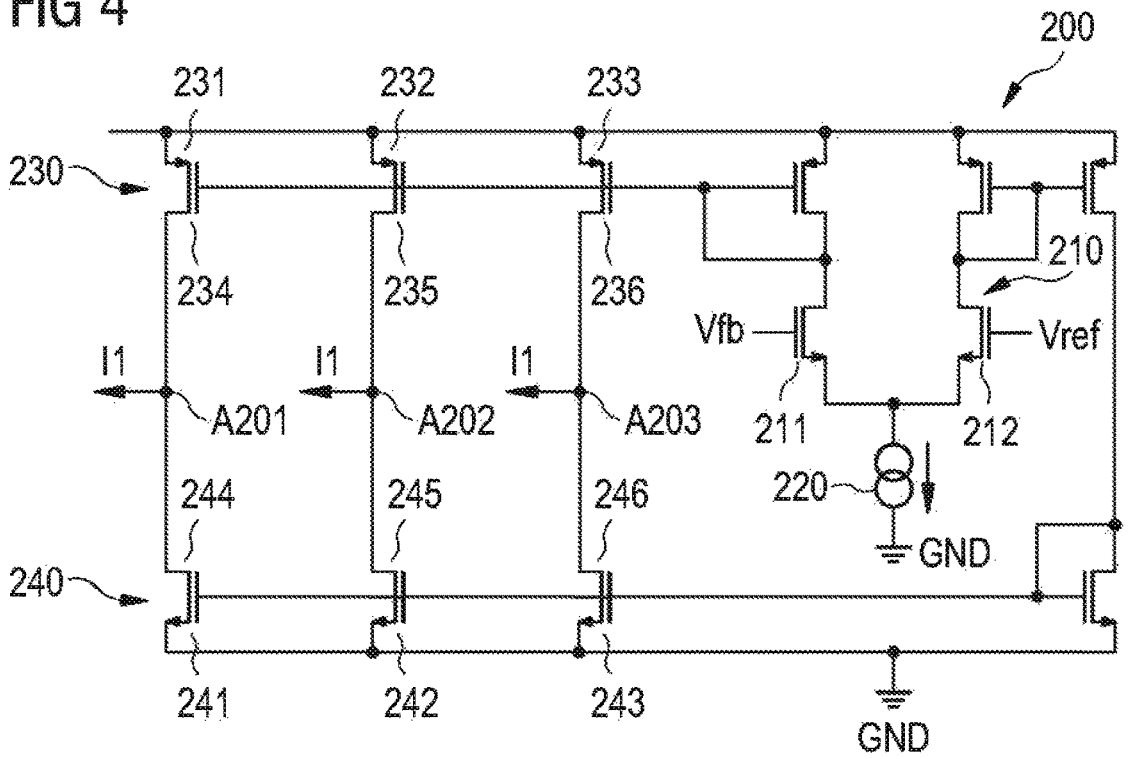
FIG. 4 shows an embodiment of an input amplifier stage of an LDO.

FIG. 4 shows a possible embodiment for the input amplifier stage 200 of the LDO 3 of FIG. 3. The embodiment of the input amplifier stage 200 shown in FIG. 4 is configured to provide the three replicas of the three control currents I1 to drive the two transimpedance stages 30 and 40 as well as the output node O. The input amplifier stage 200 comprises an amplifier stage 210 that may be configured as an NMOS amplifier stage or a PMOS amplifier stage, depending on the available dynamic range. The amplifier stage 210 comprises a transistor 211 to apply a feedback voltage Vfb derived from the regulated output voltage Vreg at the output node O and a transistor 212 to apply the reference voltage Vref. The amplifier stage 210 is connected to a current source 220.

The input amplifier stage 200 further comprises PMOS mirror stages 230 and NMOS mirror stages 240. The control current I1 provided at the output connection A201 is delivered at the connection between a PMOS transistor 234 of a first PMOS mirror stage 231 and an NMOS transistor 244 of a first NMOS mirror stage 241. The control current I1 provided at the output connection A202 of the input amplifier stage 200 is delivered at the connection between a PMOS transistor 235 of a second PMOS mirror stage 232 and an NMOS transistor 245 of a second NMOS mirror stage 242. The control current I1 provided at the output connection A203 of the input amplifier stage 200 is delivered at the connection between a PMOS transistor 236 of a third PMOS mirror stage 233 and an NMOS transistor 246 of a third NMOS mirror stage 243.

As described above, the embodiment of the input amplifier stage 200 shown in FIG. 4 comprises a plurality of mirrors. The circuit configuration of FIG. 4 may be critical in case of an offset between the mirrors. The offset can cause the control current I1 being injected in the transimpedance stage 30 and the transimpedance stage 40, when the LDO of FIG. 3 is operated in the unloaded operation state. In this case the control current I1 may be so large so that the control current I2 and the control current I3 may be compensated. As a consequence, the output drivers 110 and 120 are controlled to be operated both in a conductive state. In this case an undesired crowbar condition in which both of the output drivers 110 and 120 are operated in the conductive state is recovered.

Figure 5:
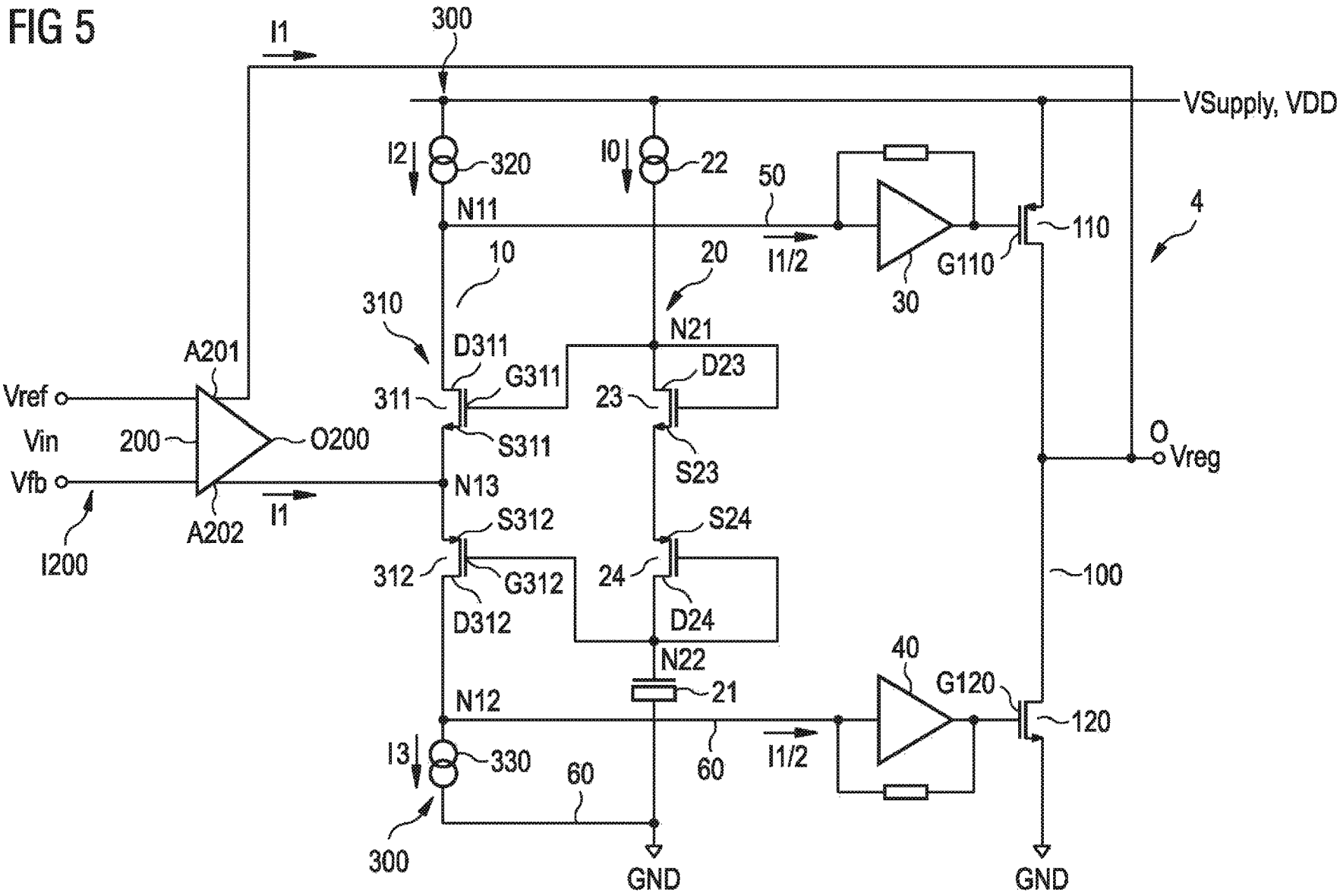
FIG. 5 shows another embodiment of an LDO having sourcing and sinking capabilities.

FIG. 5 shows an improved embodiment of an LDO 4 having sourcing and sinking capabilities. The LDO 4 shown in FIG. 5 comprises an output node O to provide a regulated output voltage Vreg. An output current branch 100 is coupled to the output node O between a supply line Vsupply to provide a supply voltage VDD and a reference potential. The output current branch 100 comprises an output driver 110 that may be configured as an output transistor and an output driver 120 that may be configured as an output transistor. Both of the output drivers are configured to be operated in a first and a second operating state. When operated in the first operating state, the respective conductivity of the output driver 110 and the output driver 120 is higher than in the second operating state of the drivers. According to a possible embodiment, the first operating state of the output drivers 110 and 120 may be a conductive state of the transistors and the second operating state may be a non-conductive state of the output drivers.

The LDO 4 further comprises an input amplifier stage 200 having an input side 1200 to apply an input signal Vin being a differential signal of the reference signal Vref and the feedback signal Vfb that is derived from the regulated output signal Vreg. The input amplifier stage 200 has an output side O200 to provide a control current I1 to control the operating state of the output driver 110 and the output driver 120. The input amplifier stage 200 generates the control current I1 in dependence on the input signal Vin.

The LDO 4 further comprises a current generator unit 300 to provide a control current I2 to operate the output driver 110 in the second operating state, for example a state of low conductivity or a non-conductive state, and to provide a control current I3 to operate the output driver 120 in the second operating state, for example a state of low conductivity or a non-conductive state, when the output current I1 at the output side O200 of the input amplifier stage 200 is below a threshold level or is a zero signal, i.e. a signal having a zero level. In particular, the current generator unit 300 generates the control current I2 and the control current I3 to operate the output drivers 110 and 120 in the low conductive or non-conductive state, when the LDO regulator is operated in the unloaded state or the control current I1 is zero or very small.

The current generator unit 300 comprises a current generator 310. The output side O200 of the input amplifier stage 200 is coupled to the current generator 310. The current generator 310 may be configured as a floating current generator. The current generator unit 300 further comprises a current generator 320 and a current generator 330 being coupled in series with the current generator 310 in a first current branch 10. The first current branch 10 is arranged between the supply line Vsupply to provide the supply potential VDD and a reference potential. The current generator 310 comprises a first transistor 311 and a second transistor 312. The first and the second transistors 311 and 312 of the first current generator 310 are of a different type of conductivity. The first transistor 311 may be configured as an NMOS transistor and the second transistor 312 may be configured as a PMOS transistor. The first transistor 311 and the second transistor 312 of the current generator 310 are connected in series such that the source node S311 of the first transistor 311 is connected to the source node 5312 of the second transistor 312 of the current generator 310. The current generator 320 is connected to the drain connection D311 of the first transistor 311 of the current generator 310. The current generator 330 is connected to the drain connection D312 of the second transistor 312 of the current generator 310.

The LDO 4 further comprises a voltage source 21, a current generator 22, a transistor 23 and a transistor 24 being connected in series in a second current branch 20 between the supply line Vsupply and a reference potential. The transistors 23 and 24 are configured as transistors of a different type of conductivity. In particular, the transistor 23 may be configured as an NMOS transistor and the transistor 24 may be configured as a PMOS transistor. According to another possible embodiment for the second current branch, the positive terminal of the voltage source 21 is coupled to the supply potential and the current generator 22 is connected from a node N22 to ground GND.

The transistor 23 and the transistor 24 of the second current branch 20 are connected in series such that the source node S23 of the transistor 23 is connected to the source S24 of the transistor 24. The current generator 22 is connected to the drain connection D23 of the transistor 23. The drain connection D24 of the transistor 24 is connected to the voltage source 21. The second current branch 20 is coupled between the supply line Vsupply to provide the supply voltage VDD and a reference potential.

A control connection G311 of the transistor 311 is connected to a node N21 of the second current branch 20 between the drain connection D23 of the transistor 23 and the current generator 22. A control connection G312 of the transistor 312 is connected to a node N22 of the second current branch 20 between the drain connection D24 of the transistor 24 and the voltage source 21. The transistors 23 and 311 as well as the transistors 24 and 312 are matched to precisely set the current of the floating generator 310.

The LDO 4 comprises a first transimpedance amplifier stage 30 being arranged between a control connection G110 of the output driver 110 and a first node N11 of the first current branch 10 between the current generator 310 and the current generator 320. In particular, the first node N11 of the first current branch 10 is arranged between the current generator 320 and the drain connection D311 of the transistor 311.

The LDO 4 further comprises a second transimpedance amplifier stage 40 being arranged between a control connection G120 of the output driver 120 and a second node N12 of the first current branch 10 between the current generator 310 and the current generator 330. In particular, the second node N12 of the first current branch 10 is arranged between the drain connection D312 of the transistor 312 of the current generator 310 and the current generator 330.

The input amplifier stage 200 comprises at the output side O200 a first output connection A201 to provide/receive the control current I1. The output connection A201 of the input amplifier stage 200 is coupled to the output node O of the LDO 4. The input amplifier stage 200 is configured to provide the control current I1 at the output connection A201, when the LDO is operated in the sourcing operation mode. The input amplifier stage 200 is configured to receive the control current I1 at the output connection A201, when the LDO 4 is operated in the sinking operation mode.

The input amplifier stage 200 further comprises at the output side O200 an output connection A202 to provide/receive the control current I1. The output connection A202 of the input amplifier stage 200 is connected to a third node N13 of the first current branch 10 between the source connection 5311 of the transistor 311 and the source connection 5312 of the transistor 312. The input amplifier stage 200 is configured to provide the control current I1 at the output connection A202, when the LDO 4 is operated in the sourcing operation mode. The input amplifier stage 200 is further configured to receive the control current I1 at the output connection A202, when the LDO 4 is operated in the sinking operation mode.

The output driver 110 is operated in the first operating state, i.e. in the operating state in which the output driver 110 has a high conductivity, and the output driver 120 is operated in the second operating state, in which the output driver 120 has a low conductivity or is in the non-conductive state, when the control current I1 provided at the output connection A202 of the input amplifier stage 200 enters the current generator 310.

The output driver 110 is operated in the second operating state in which the output driver 110 has a low conductivity or is operated in the non-conductive state, and the output driver 120 is operated in the first operating state, in which the output driver 120 has a high conductivity, when the control current I1 received at the output connection A202 of the input amplifier stage 200 exits the current generator 310.

The input amplifier stage 200 can be any kind of differential pair that generates a control current I1 under an input signal Vin. According to a possible embodiment, the input amplifier stage can be configured as shown in FIG. 4, where only two matched paths for the control current I1 are needed.

Figure 6:
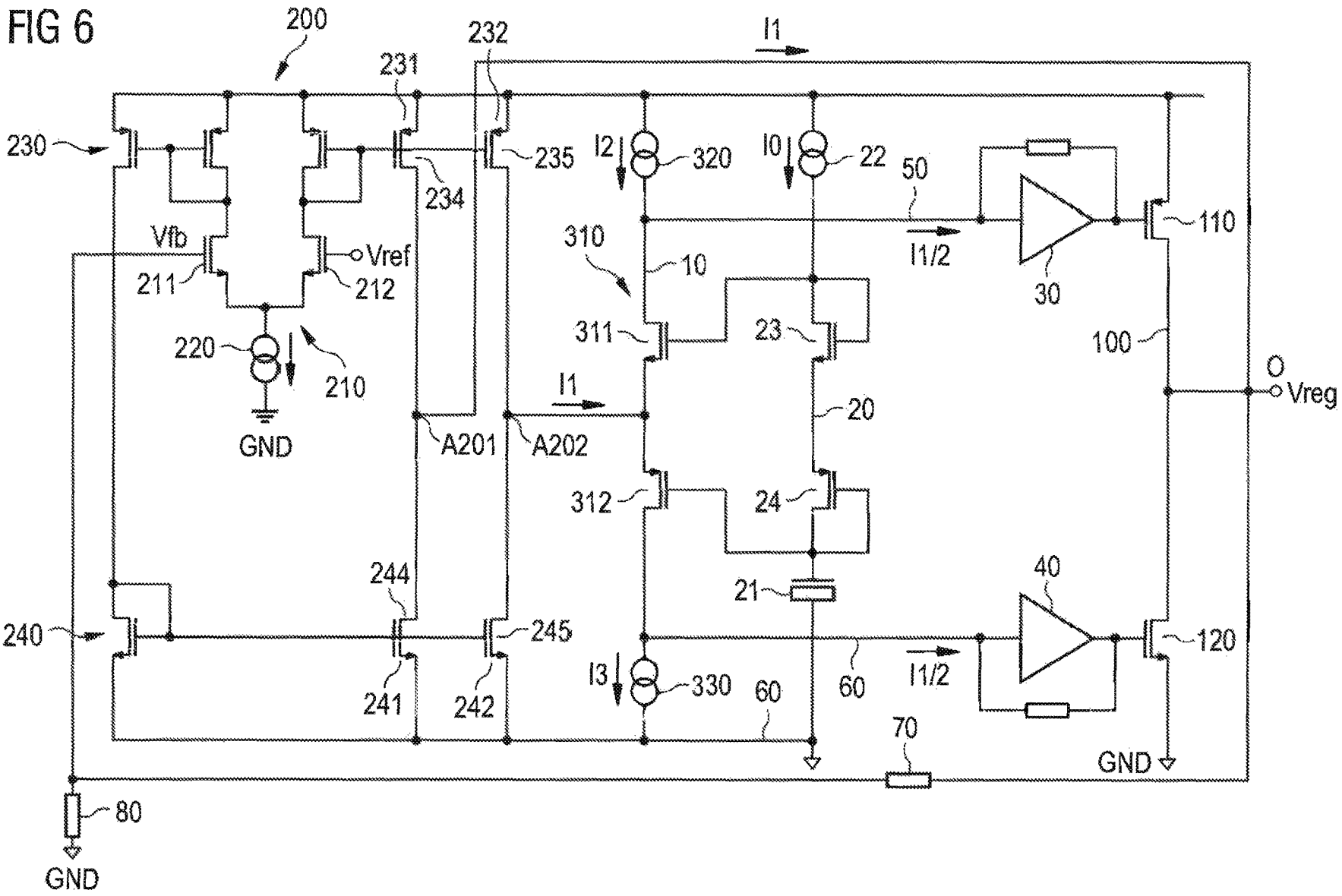
FIG. 6 shows an embodiment of an LDO having sourcing and sinking capabilities with a feedback net to provide a feedback path from the output node of the LDO to the input amplifier stage.

FIG. 6 shows the LDO 4 with an embodiment of the input amplifier stage 200 in greater detail. The input amplifier stage 200 comprises an amplifier stage 210 that is connected to a current source 220. The amplifier stage 210 may be configured as an NMOS stage comprising a transistor 211 to receive a feedback signal/voltage Vfb derived from the regulated output signal/voltage Vreg and a transistor 212 to apply a reference signal/voltage Vref. The feedback voltage Vfb received at a control terminal of transistor 211 is derived from the regulated output voltage Vreg by means of a feedback net comprising a resistor divider of the resistors 70 and 80.

The input amplifier stage 200 further comprises PMOS mirror stages 230 and NMOS mirror stages 240. The control current I1 provided at the output connection A201 of the input amplifier stage is delivered at the connection between a transistor 234, for example a PMOS transistor, of a first PMOS mirror stage 231, and a transistor 244, for example an NMOS transistor, of a first NMOS mirror stage 241. The output connection A202 of the input amplifier stage 200 to provide/receive the control current I1 is located at a connection between a transistor 235, for example a PMOS transistor, of a second PMOS mirror stage 232 and a transistor 245, for example an NMOS transistor, of a second NMOS mirror stage 242. Regarding the other components of the LDO regulator 4 shown in FIG. 6, reference is made to FIG. 5.

The LDO regulator 4 shown in FIGS. 5 and 6 is configured as a class AB LDO. Depending on the input range, the input amplifier stage 200 can comprise either a P-MOS or N-MOS differential pair and may be even a folded solution.

A very low impedance set by the transconductance of the transimpedance amplifier stages 30 and 40, drives the large gates of the output transistors 110 and 120. In addition the shared signal I1 to drive both pullup and pulldown sections comes as a current mode one, hence no high impedance nodes are present in the loop: Miller compensation is not required and the associated constraints about a load cap and current vanish. In addition, the transimpedance stages 30 and 40 offer a minimum number of high order poles to ensure excellent phase margin to the structure. In this way, the regulated output might play the role of the dominant pole.

A small offset current, injected in the transimpedance stages 30 and 40 by the floating generator represented by the transistors 311, 312 and 23, 24, brings the power devices 110 and 120 in the low-conductive-state/off-state, when no current I1 comes from the input amplifier stage 200. A current which is matched to the one generated by the input pair closes the loop in this operating condition with minimal drive capability. The LDO stability is enforced by exploiting the benefits of the transimpedance amplifier stages 30 and 40 in both senses of the load current.

According to the embodiment of the LDO 4 shown in FIGS. 5 and 6, the input amplifier stage 200 is a transconductance stage having two output connections A201, A202 only instead of three output connections, as shown for the embodiment of the LDO 3 of FIG. 3. The offset in the transimpedance stages 30 and 40 is obtained via a series combination of a floating generator, i.e. the transistors 311 and 312, plus two current generators 320 and 330. Assuming the current generator 22 provides a current I0=Ia, the current generator 320 provide the control current I2=Ia−ε and the current generator 330 provides the control current I3=Ib. Of course, to have a symmetrical offset for equal resistors in the transimpedance stage, it is possible to set the control current I3 provided by the current generator 330 equal to Ia−ε, i.e. equal to the control current I2 provided by the current generator 320.

The transistors 311 and 23 are a matched pair as well as the transistors 312 and 24. In this way they force a current Ia in the absence of any contribution of the control current I1. As soon as the parameter ε is set to ε>0, a residual current ε*Ia is injected in both the transimpedance stages 30 and 40 to turn off the output drivers 110 and 120.

At the same time, the floating generator acts as a control current splitter as well. Assuming that the same impedance is seen at the source connections of the transistors 311 and 312, the control current I1 provided at the output connection A202 of the input amplifier stage 200 is split half in the upper LDO branch 50, i.e. to the control connection of the output driver 110 and half in the lower LDO branch 60, i.e. to the control connection of the output driver 120.

If the control current I1 is entering the current generator 310, it would tend to subtract current in the LDO lower branch 60 to the control connection of the output driver 120 and increase current in the LDO upper branch 50 to the control connection of the output driver 110. In this case the LDO 4 is operated in the sourcing operating state in which the output driver 110 is operated in the conductive state and the output driver 120 is operated in a low-conductive/non-conductive state. On the other hand, if the control current I1 is exiting the current generator 310, it would tend to increase the current in the lower LDO branch 60 to the control connection of the output driver 120 and subtract current in the upper LDO branch 50 to the control connection of the output driver 110. In this case the LDO 4 is operated in the sinking operation mode in which the output driver 110 is operated in a low conductive state/non-conductive state and the output driver 120 is operated in a high conductive state.

In this way, the implementation of the current splitter makes any offset internal to the input amplifier stage 200 ineffective to crowbar generation. This is an advantage in comparison to the embodiment of the LDO 3 shown in FIG. 3 with the input amplifier stage 200 shown in FIG. 4, where the control current I1 for the pull-up device 110 and the pull-down device 120 are obtained via replica mirrors. According to the embodiment of the LDO 3 shown in FIGS. 3 and 4, the transistors in the P-MOS mirror stages and the N-MOS mirror stages might generate DC contributions forcing conduction in both of the driver sections 110 and 120.

Thus, according to the embodiment of the LDO 4, a large degree of matching is not needed in the mirrors of the input amplifier stage 200. As a result, smaller and less, i.e. two instead of three, replica current generators that make the overall signal path faster, are obtained. On the other side, it is clear that crowbar minimization asks for the highest degree of matching between the three series current generators of the current splitter, i.e. the current generator 310, 320 and 330.

Anyhow, the current generators 320 and 330 do not belong to the signal paths 50, 60 and even if they are very large signal speed is not significantly affected for extreme matching characteristic. In fact, the impedance at the source connections of the transistors 311 and 312 is one of the lowest in the loop as given by the parallel connection of two transconductances, unlike the mirrors in FIG. 4. Hence, it can be fast enough even if highly loaded by a large parasitic.

LIST OF REFERENCE SIGNS

1, 2, 3 embodiments of LDO regulators
10, 20 current branches of the LDO
21 voltage source
22 current generator
23, 24 transistors
30, 40 transimpedance amplifier stages
50, 60 upper and lower LDO branch
70, 80 resistors
100 output current branch
110, 120 output drivers
200 input amplifier stage
210 amplifier stage
220 current generator
230 PMOS mirrors
240 NMOS mirrors
300 current generator unit
310, 320, 330 current generators
O output node
I1, I2, I3 control currents
Vreg regulated output voltage
Vin input signal
Vref reference signal
Vfb feedback signal

The invention claimed is:

1. A low-dropout regulator, comprising:

an output node to provide a regulated output voltage, an output current branch coupled to the output node, the output current branch comprising a first output driver and a second output driver, wherein the first and the second output driver are configured to be operated in a first and a second operating state, wherein the respective conductivity of the first and the second output driver is higher in the first operating state than in the second operating state, an input amplifier stage having an input side to apply an input signal and an output side to provide a first control current to control the operating state of the first and the second output driver, wherein the input amplifier stage generates the first control current in dependence on the input signal, and a current generator unit to provide a second control current to operate the first output driver in the second operating state and to provide a third control current to operate the second output driver in the second operating state, when the first control current at the output side of the input amplifier stage is below a threshold level.

2. The low-dropout regulator of claim 1, wherein the current generator unit comprises a first current generator, and wherein the output side of the input amplifier stage is coupled to the first current generator.

3. The low-dropout regulator of claim 2, wherein the first current generator is configured as a floating current generator.

4. The low-dropout regulator of claim 2, wherein the first output driver is operated in the first operating state and the second output driver is operated in the second operating state, when the first control current enters the first current generator, and wherein the first output driver is operated in the second operating state and the second output driver is operated in the first operating state, when the first control current exits the first current generator.

5. The low-dropout regulator of claim 1, comprising:

a first current branch, wherein the current generator unit comprises a second current generator and a third current generator being coupled in series with the first current generator in the first current branch.

6. The low-dropout regulator of claim 2, wherein the first current generator comprises a first transistor and a second transistor being of a different type of conductivity.

7. The low-dropout regulator of claim 6, wherein the first transistor and the second transistor are connected in series such that a source node of the first transistor is connected to a source node of the second transistor.

8. The low-dropout regulator of claim 7, comprising:

a second current branch, wherein the second current branch comprises a voltage source and a fourth current generator and third transistor and a fourth transistor being connected in series in the second current branch, the third and fourth transistor being of a different type of conductivity.

9. The low-dropout regulator of claim 8, wherein the third transistor and the fourth transistor are connected in series such that a source node of the third transistor is connected to a source node of the fourth transistor.

10. The low-dropout regulator of claim 8, wherein a control connection of the first transistor is connected to a first node of the second current branch between a drain connection of the third transistor and the fourth current generators, and wherein a control connection of the second transistor is connected to a second node of the second current branch between a drain connection of the fourth transistors and the voltage source.

11. The low-dropout regulator of claim 5, comprising:

a first transimpedance amplifier stage being arranged between a control connection of the first output driver and a first node of the first current branch between the first current generator and the second current generator, and a second transimpedance amplifier stage being arranged between a control connection of the second output driver and a second node of the first current branch between the first current generator and the third current generator.

12. The low-dropout regulator of claim 5, wherein the input amplifier stage comprises at the output side a first output connection to provide/receive the first control current, wherein the first output connection of the input amplifier stage is coupled to the output node of the low-dropout regulator, and wherein the input amplifier stage comprises at the output side a second output connection to provide/receive the first control current, wherein the second output connection of the input amplifier stage is coupled to a third node of the first current branch between a source connection of the first transistor and a source connection of the second transistor.

13. The low-dropout regulator of claim 1, comprising:

a first transimpedance amplifier stage being connected to a control connection of the first output driver, and a second transimpedance amplifier stage being connected to a control connection of the second output driver, wherein the input amplifier stage comprises at the output side a first output connection to provide/receive the first control current, wherein the first output connection of the input amplifier is connected to the output node of the low-dropout regulator, and wherein the input amplifier stage comprises at the output side a second output connection and a third output connection to provide/receive the first control current, wherein the second output connection of the input amplifier stage is connected to the first transimpedance amplifier stage and the third output connection of the input amplifier stage is connected to the second transimpedance amplifier stage.

14. The low-dropout regulator of claim 13, wherein the current generator unit comprises a first current generator and a second current generator, wherein the first current generator is connected to the first transimpedance amplifier stage to provide a second control current to operate the first output driver in the second operating state, and wherein the second current generator is connected to the second transimpedance amplifier stage to provide a third control current to operate the second output driver in the second operating state.

15. The low-dropout regulator of claim 1, wherein the first output driver is configured as a transistor of a first type of conductivity and the second output driver is configured as a transistor of a second type of conductivity being different from the first type of conductivity.

* * * * *